US012606408B2

(12) United States Patent
Murata et al.

(10) Patent No.: US 12,606,408 B2
(45) Date of Patent: Apr. 21, 2026

(54) SHEET POSTPROCESSING APPARATUS TO WHICH OPTIONAL UNIT CAN BE REMOVABLY ATTACHED

(71) Applicant: KYOCERA Document Solutions Inc., Osaka (JP)

(72) Inventors: Koji Murata, Osaka (JP); Tadahisa Kishimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 229 days.

(21) Appl. No.: 18/736,664

(22) Filed: Jun. 7, 2024

(65) Prior Publication Data

US 2024/0417206 A1 Dec. 19, 2024

(30) Foreign Application Priority Data

Jun. 15, 2023 (JP) ..... 2023-098695

(51) Int. Cl.
*B65H 37/06* (2006.01)
*B65H 5/06* (2006.01)

(52) U.S. Cl.
CPC ..... *B65H 37/06* (2013.01); *B65H 5/062* (2013.01); *B65H 2402/10* (2013.01); *B65H 2403/942* (2013.01); *B65H 2801/27* (2013.01)

(58) Field of Classification Search
CPC .... B65H 37/06; B65H 5/062; B65H 2402/10; B65H 2403/942; B65H 2801/27; B65H 45/16; B65H 29/20; B65H 2701/1131; B65H 2801/03; B65H 2701/11232; B65H 45/18; B65H 45/14; B65H 2301/17
See application file for complete search history.

(56) References Cited

U.S. PATENT DOCUMENTS 5,164,906 A * 11/1992 Mahmoodi ..... G05B 19/0421 271/9.12
6,224,530 B1 * 5/2001 Okelmann ..... B65H 45/147 493/476
11,926,500 B2 * 3/2024 Kishimoto ..... B65H 45/162
2006/0163799 A1 * 7/2006 Goh ..... B65H 1/00 271/186
2022/0242084 A1 8/2022 Kishimoto et al.

FOREIGN PATENT DOCUMENTS

JP 2022119433 A 8/2022

* cited by examiner

*Primary Examiner* — Timothy R Waggoner
(74) *Attorney, Agent, or Firm* — IP Business Solutions, LLC.

(57) ABSTRACT

A sheet postprocessing apparatus includes a postprocessing device that performs postprocessing on a sheet, and a drive unit having a motor for transporting the sheet. The postprocessing device includes an optional unit mounting base. On the optional unit mounting base, one of a folding unit having a function to fold the sheet, and a basic unit without the folding function can be selectively mounted. When the folding unit is mounted on the optional unit mounting base, a bidirectional motor capable of rotating forward and reversely is additionally provided in the drive unit, in addition to a forward rotation motor capable of rotating forward, which is permanently provided.

7 Claims, 6 Drawing Sheets

SHEET POSTPROCESSING APPARATUS TO WHICH OPTIONAL UNIT CAN BE REMOVABLY ATTACHED

INCORPORATION BY REFERENCE

This application claims priority to Japanese Patent Application No. 2023-098695 filed on Jun. 15, 2023, the entire contents of which are incorporated by reference herein.

BACKGROUND

The present disclosure relates to a sheet postprocessing apparatus.

A sheet postprocessing apparatus, having a folding function and capable of forming two creases on a sheet, has been disclosed.

SUMMARY

The disclosure proposes further improvement of the foregoing techniques.

In an aspect, the disclosure provides a sheet postprocessing apparatus including a sheet inlet, a first transport lane, a postprocessing device, and a drive unit. Through the sheet inlet, a sheet on which an image has been formed by an image forming apparatus is introduced. On the first transport lane, the sheet introduced through the sheet inlet is transported. The postprocessing device performs postprocessing on the sheet. The drive unit includes a forward rotation motor capable of rotating forward, and configured to supply driving force for transporting the sheet. The postprocessing device includes an optional unit mounting base. The optional unit mounting base is configured to allow one of a folding unit having a function to fold the sheet, and a basic unit without the folding function, to be selectively mounted. The drive unit includes a structure for additionally mounting a bidirectional motor capable of rotating reversely. When the basic unit is mounted on the optional unit mounting base, the drive unit supplies the driving force from the forward rotation motor. When the folding unit is mounted on the optional unit mounting base, the drive unit supplies the driving force from the forward rotation motor and the bidirectional motor additionally mounted in the drive unit.

DETAILED DESCRIPTION

Figure 1:
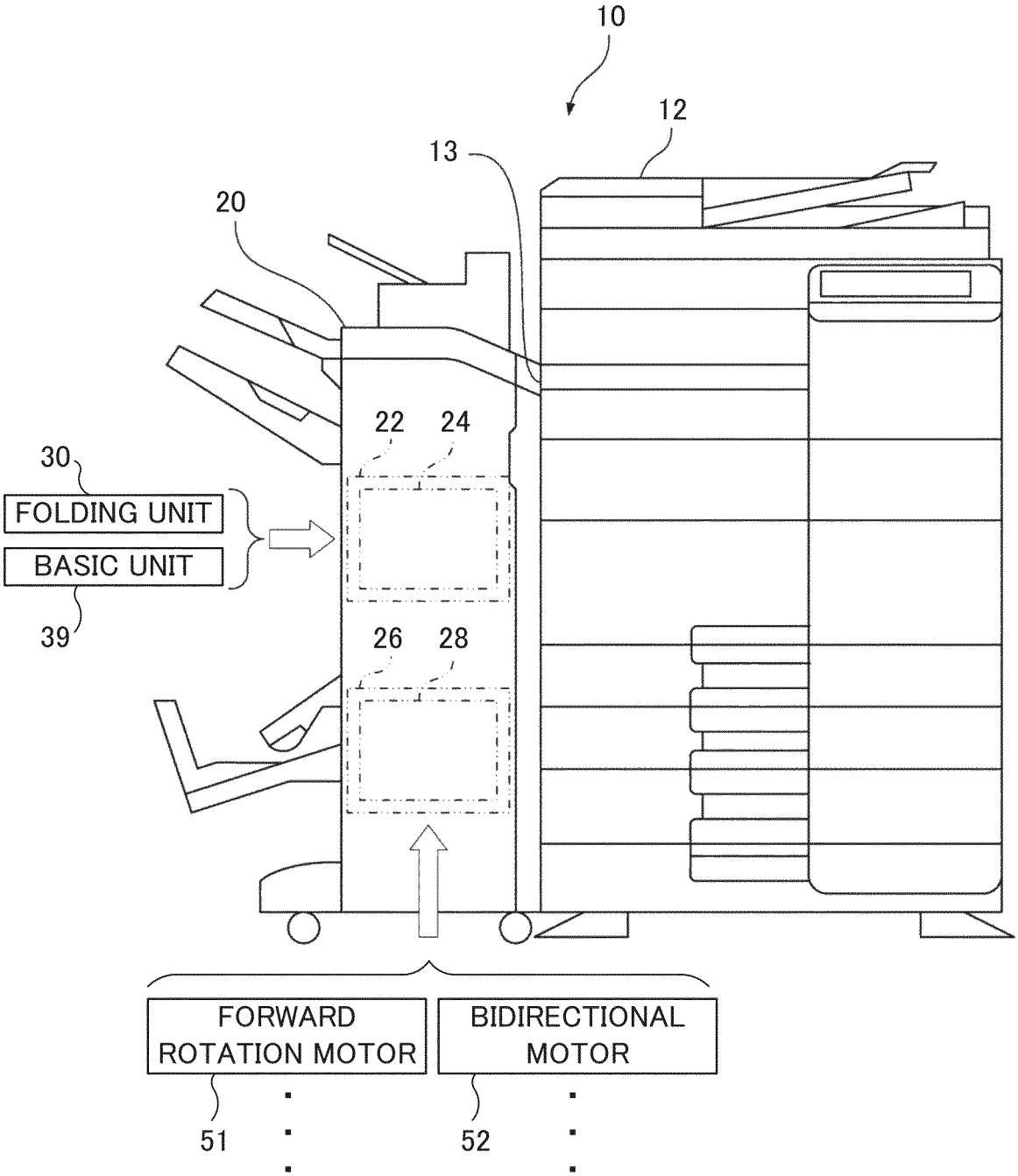
FIG. 1 is a schematic drawing showing a multifunction peripheral including a sheet postprocessing apparatus.

Hereafter, a sheet postprocessing apparatus according to an embodiment of the disclosure will be described, with reference to the drawings. In the drawings, the same or corresponding elements are given the same reference numeral, and the description of such elements will not be repeated.

Referring first to FIG. 1, a configuration of the sheet postprocessing apparatus 20 will be described. FIG. 1 is a schematic drawing showing a multifunction peripheral 10 including the sheet postprocessing apparatus 20. The multifunction peripheral 10 includes an image forming apparatus 12 and a sheet postprocessing apparatus 20. The image forming apparatus 12 forms an image on a sheet, typically a paper sheet.

The sheet postprocessing apparatus 20 is attached to the image forming apparatus 12. The sheet postprocessing apparatus 20 includes a sheet inlet 13, located between the sheet postprocessing apparatus 20 and the image forming apparatus 12. The sheet on which an image has been formed by the image forming apparatus 12 is introduced into the sheet postprocessing apparatus 20, through the sheet inlet 13.

The sheet postprocessing apparatus 20 includes a postprocessing device 22 and a drive unit 26. The postprocessing device 22 performs postprocessing on the sheet, such as punching, stapling, and folding. The postprocessing device 22 includes an optional unit mounting base 24.

The optional unit mounting base 24 is configured to allow an optional unit, having the necessary function in accordance with the function required from the sheet postprocessing apparatus 20, to be selectively mounted. On the optional unit mounting base 24 shown in FIG. 1, one of a folding unit 30 and a basic unit 39 can be selectively mounted.

The folding unit 30 has a folding function, for folding the sheet. The basic unit 39 is without the folding function.

The drive unit 26 includes a motor 28, for transporting the sheet inside the sheet postprocessing apparatus 20. The drive unit 26 includes at least one forward rotation motor 51, capable of rotating forward. When the basic unit 39 is mounted on the optional unit mounting base 24, only the forward rotation motors 51 are provided in the drive unit 26.

In contrast, when the folding unit 30 is mounted on the optional unit mounting base 24, at least one bidirectional motor 52, capable of rotating both forward and reversely, is additionally provided in the drive unit 26, in addition to the forward rotation motor 51 already provided.

In the sheet postprocessing apparatus 20 shown in FIG. 1, the basic unit 39 is mounted on the optional unit mounting base 24, when it is unnecessary to utilize the folding function. When it becomes necessary to utilize the folding function in the sheet postprocessing apparatus 20, the basic unit 39 is replaced with the folding unit 30, and a necessary number of bidirectional motors 52 are additionally provided in the drive unit 26.

As described above, in the sheet postprocessing apparatus 20 shown in FIG. 1, the folding function can be added, simply by replacing the optional unit to be mounted on the optional unit mounting base 24, and providing the bidirectional motor 52, without the need to replace the sheet postprocessing apparatus 20 itself as a whole. Therefore, the folding function can be easily added or removed, and the cost for adding or removing the folding function can be reduced. Thus, the sheet postprocessing apparatus 20 includes the forward rotation motor 51 as a permanent component, and is configured to allow the bidirectional motor 52 to be mounted and removed.

Figure 2:
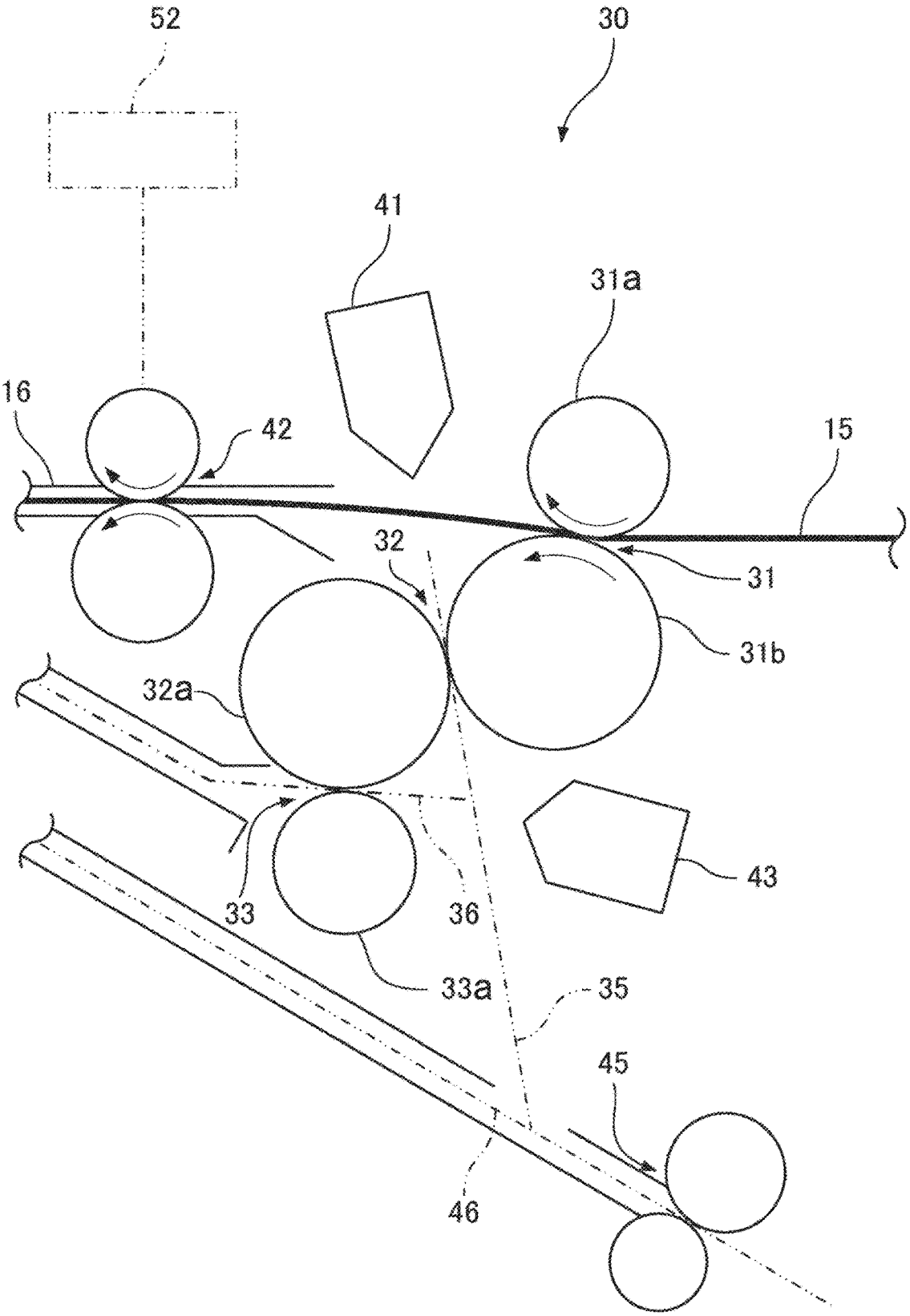
FIG. 2 is a schematic drawing showing a sheet being transported along a first transport lane, in a folding unit.
Figure 3:
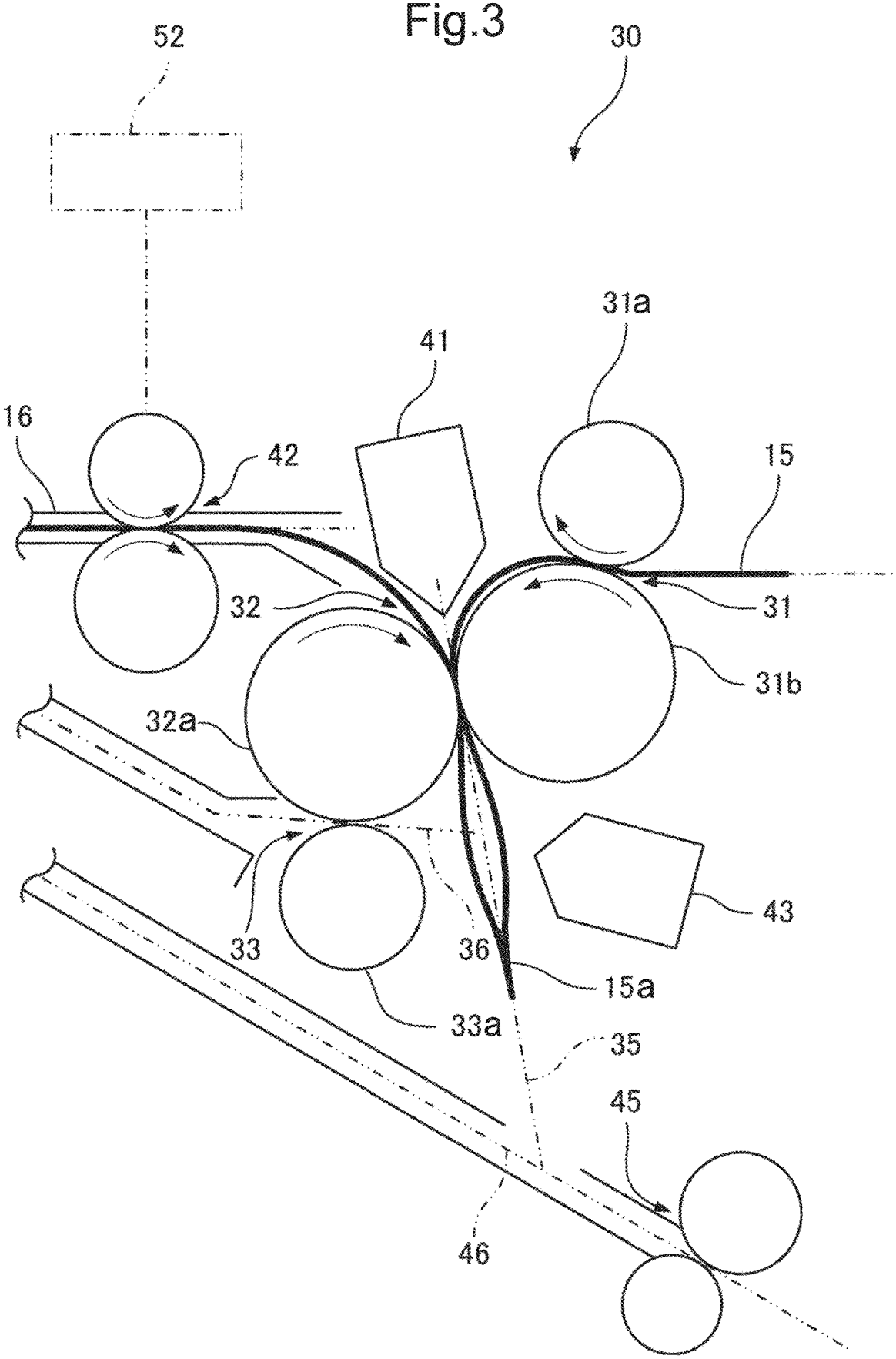
FIG. 3 is a schematic drawing showing the sheet subjected to a first folding process.
Figure 4:
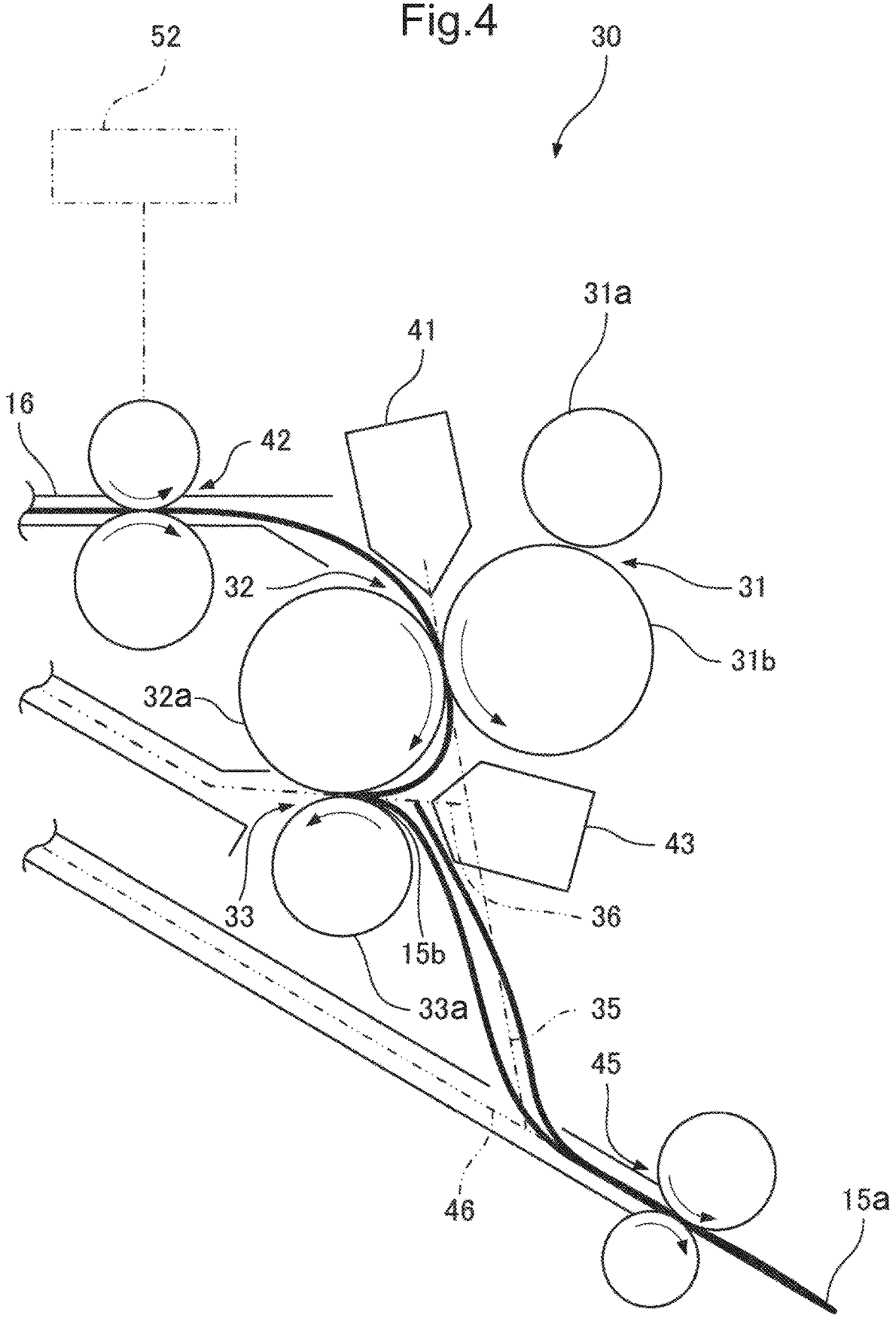
FIG. 4 is a schematic drawing showing the sheet subjected to a second folding process.

Referring now to FIG. 1, FIG. 2, FIG. 3, FIG. 4, and FIG. 5, the folding operation applied to a sheet 15, by the folding unit 30 in the sheet postprocessing apparatus 20, will be described hereunder. FIG. 2 is a schematic drawing showing the sheet 15 being transported along a first transport lane 16, in the folding unit 30. FIG. 3 is a schematic drawing showing the sheet 15 being subjected to a process of making a first folding 15*a*. FIG. 4 is a schematic drawing showing the sheet 15 being subjected to a process of making a second folding 15*b*.

First, the sheet 15 on which an image has been formed by the image forming apparatus 12 is introduced into the sheet postprocessing apparatus 20, through the sheet inlet 13. The sheet 15 introduced through the sheet inlet 13 is transported on the first transport lane 16.

The sheet 15 transported on the first transport lane 16 passes the postprocessing device 22. In the postprocessing device 22, the sheet 15 is subjected to the postprocessing, such as punching, stapling, or folding.

When the folding unit 30 is mounted on the optional unit mounting base 24, the sheet 15 is subjected to the folding operation. The sheet 15 in the folding unit 30 is at first transported on the first transport lane 16, as shown in FIG. 2.

The folding unit 30 includes a first roller pair 31, a second roller pair 32, a third roller pair 33, and a folded sheet transport lane 36.

The sheet postprocessing apparatus 20 includes a second transport lane 35, a first guide 41, a reverse transport device 42, a second guide 43, a retention roller pair 45, and a third transport lane 46. When the folding unit 30 is mounted on the optional unit mounting base 24, the first roller pair 31, the second roller pair 32, the third roller pair 33, and the folded sheet transport lane 36, included in the folding unit 30, are each structurally engaged with the sheet postprocessing apparatus 20, thereby constituting a part thereof. The mentioned components serve to perform the transport and postprocessing of the sheet, in collaboration with the second transport lane 35, the first guide 41, the reverse transport device 42, the second guide 43, the retention roller pair 45, and the third transport lane 46, which are already provided in the sheet postprocessing apparatus 20, as shown in FIG. 2. The optional unit mounting base 24 provided in the sheet postprocessing apparatus 20 is configured to enable the folding unit 30 to be mounted and removed, in other words the first roller pair 31, the second roller pair 32, the third roller pair 33, and the folded sheet transport lane 36 to be mounted and removed.

The roller pairs are each composed of two rollers. One of the two rollers constituting the roller pair is made to rotate by the driving force from the drive unit 26, and the other roller passively rotates in contact with the first mentioned roller, rotating with the driving force. Here, both of the rollers constituting the roller pair may be made to rotate by the driving force.

The first roller pair 31 transports the sheet 15 on the first transport lane 16, pinching the sheet 15 between the rollers. The first roller pair 31 includes a first roller 31*a* and a second roller 31*b*. In FIG. 2, the first roller 31*a* is located on the upper side of the first transport lane 16. The second roller 31*b* is located on the lower side of the first transport lane 16.

The second roller pair 32 applies the first folding 15*a* to the sheet 15. The second roller pair 32 is located at a position that allows the second transport lane 35, intersecting the first transport lane 16, to pass between the second roller pair 32. In FIG. 2, the second transport lane 35 is downwardly intersecting the first transport lane 16.

The second roller pair 32 is composed of the second roller 31*b*, and a third roller 32*a*. In other words, the second roller 31*b* constitutes a part of both of the first roller pair 31 and the second roller pair 32, at the same time. In FIG. 2, the second roller 31*b* is located on the right of the second transport lane 35. The third roller 32*a* is located on the left of the second transport lane 35.

The third roller pair 33 applies the second folding 15*b* to the sheet 15. The third roller pair 33 is located at the position for pinching the folded sheet transport lane 36, intersecting the second transport lane 35. In FIG. 2, the folded sheet transport lane 36 is intersecting the second transport lane 35, to the left side thereof. On the folded sheet transport lane 36, the sheet 15 that has been subjected to the first folding 15*a* and the second folding 15*b* is transported.

The third roller pair 33 is composed of the third roller 32*a*, and a fourth roller 33*a*. In other words, the third roller 32*a* constitutes a part of both of the second roller pair 32 and the third roller pair 33, at the same time. In FIG. 2, the third roller 32*a* is located on the upper side of the folded sheet transport lane 36. The fourth roller 33*a* is located on the lower side of the folded sheet transport lane 36.

As described above, the three roller pairs, namely the first roller pair 31, the second roller pair 32, and the third roller pair 33 are composed of four rollers, namely the first roller 31*a*, the second roller 31*b*, the third roller 32*a*, and the fourth roller 33*a*. Although normally six rollers are necessary to form three roller pairs, the number of rollers is reduced, in the folding unit 30 shown in FIG. 2. Since the number of rollers can thus be reduced, in the folding unit 30, which has to have a plurality of roller pairs, the sheet postprocessing apparatus 20, including the folding unit 30, can be made smaller in size. Further, the manufacturing cost of the sheet postprocessing apparatus 20 can be reduced.

The first guide 41 is located so as to oppose the second roller pair 32, on the upper side of the position where the first transport lane 16 and the second transport lane 35 intersect. The first guide 41 includes a projection, sticking out toward the second transport lane 35. In addition, the first guide 41 is movable toward the second transport lane 35. When the first guide 41 moves toward the second transport lane 35, the projection of the first guide 41 contacts and presses the sheet 15 on the first transport lane 16, so that the portion of the sheet 15 contacted by the first guide 41 is guided to the second transport lane 35.

The reverse transport device 42 is configured to reverse the transport direction of the sheet 15. The reverse transport device 42 shown in FIG. 2 includes a roller pair for pinching therebetween the sheet 15 on the first transport lane 16.

In the sheet postprocessing apparatus 20, one or a plurality of reverse transport devices 42 may be provided. Although a single reverse transport device 42 is provided in FIG. 2, two or more reverse transport devices 42 may be provided, depending on the type of the folding operation to be applied to the sheet 15.

When the folding unit 30 is mounted on the optional unit mounting base 24, the reverse transport device 42 is driven by the bidirectional motor 52 provided in the drive unit 26.

Here, it is preferable that the roller pairs not involved in the reversing operation of the sheet 15, such as the first roller pair 31, are driven by the forward rotation motor 51, which can only rotate forward.

The bidirectional motor 52 engaged with the reverse transport device 42 is rotating forward, in the situation shown in FIG. 2. When the bidirectional motor 52 is rotating forward, the reverse transport device 42 transports the sheet 15 in the same direction as the first roller pair 31.

The second guide 43 is located so as to oppose the third roller pair 33, on the right side of the position where the second transport lane 35 and the folded sheet transport lane 36 intersect. The second guide 43 includes a projection, sticking out toward the folded sheet transport lane 36. In addition, the second guide 43 is movable toward the folded sheet transport lane 36. When the second guide 43 moves toward the folded sheet transport lane 36, while the sheet 15 is present on the second transport lane 35, the projection of the second guide 43 the sheet 15. Accordingly, the portion of the sheet 15 contacted by the second guide 43 is guided to the folded sheet transport lane 36.

The retention roller pair 45 is located at a position that allows the third transport lane 46, intersecting the second transport lane 35, to pass between the retention roller pair 45. In FIG. 2, the third transport lane 46 is intersecting the second transport lane 35 at the position on the lower side of the folded sheet transport lane 36, in other words at the position more distant from the first transport lane 16, with respect to the intersection of the second transport lane 35 and the folded sheet transport lane 36. The third transport lane 46 shown in FIG. 2 extends in the left-right direction, from the intersection with the second transport lane 35. In addition, the third transport lane 46 shown in FIG. 2 is obliquely inclined to the lower right side, away from the first transport lane 16, in the direction opposite to the transport direction of the folded sheet transport lane 36, in other words to the right. The retention roller pair 45 shown in FIG. 2 is located at the position spaced from the intersection of the second transport lane 35 and the third transport lane 46, to the lower right side.

When the sheet 15 is subjected to the folding operation, the bidirectional motor 52 is made to rotate reversely, so that the transport direction of the sheet 15 is reversed by the reverse transport device 42, and the sheet 15 is led to the second roller pair 32 and the third roller pair 33.

When the transport direction of the sheet 15 is reversed by the reverse transport device 42, the first roller pair 31 and the reverse transport device 42 attempt to transport the sheet 15 in opposite directions to each other, as shown in FIG. 3.

To be more specific, while the first roller pair 31 attempts to transport the sheet 15 to the left in FIG. 3, the reverse transport device 42 attempts to transport the sheet 15 to the right in FIG. 3. Accordingly, the portion of the sheet 15 on the upstream side in the transport direction (right side in FIG. 3) is subjected to force exerted to the left, and the portion on the downstream side in the transport direction (left side in FIG. 3) is subjected to force exerted to the right. Therefore, the sheet 15 is subjected to the force that urges the sheet 15 to proceed to the intersection of the first transport lane 16 and the second transport lane 35, from both of the upstream and downstream sides in the transport direction.

Thus, when the transport direction of the sheet 15 is reversed by the reverse transport device 42, the first guide 41 is moved toward the second transport lane 35. Since the sheet 15 is subjected to the force exerted toward the intersection of the first transport lane 16 and the second transport lane 35, the portion of the sheet 15 contacted by the first guide 41 is guided to the second transport lane 35.

When the portion of the sheet 15 guided toward the second transport lane 35 is pinched between the second roller pair 32 as shown in FIG. 3, the first folding 15*a* is formed on the sheet 15.

Referring to FIG. 4, the portion of the sheet 15 where the first folding 15*a* has been formed then proceeds along the second transport lane 35 and the third transport lane 46, and is caught between the retention roller pair 45. The retention roller pair 45 transports the portion of the first folding 15*a* along the third transport lane 46. Since the retention roller pair 45 is transporting the portion of the first folding 15*a*, after the upstream end of the sheet 15 in the transport direction passes the first roller pair 31, the downstream side of the sheet 15 in the transport direction is led toward the second transport lane 35, by the reverse transport device 42 and the retention roller pair 45.

When the upstream end of the sheet 15 in the transport direction reaches the intersection of the second transport lane 35 and the folded sheet transport lane 36, the second guide 43 moves toward the folded sheet transport lane 36.

Accordingly, the portion of the sheet 15 contacted by the second guide 43 is guided to the folded sheet transport lane 36. Then, when the portion guided to the folded sheet transport lane 36 is pinched between the third roller pair 33 as shown in FIG. 4, the second folding 15*b* is formed on the sheet 15.

Figure 5:
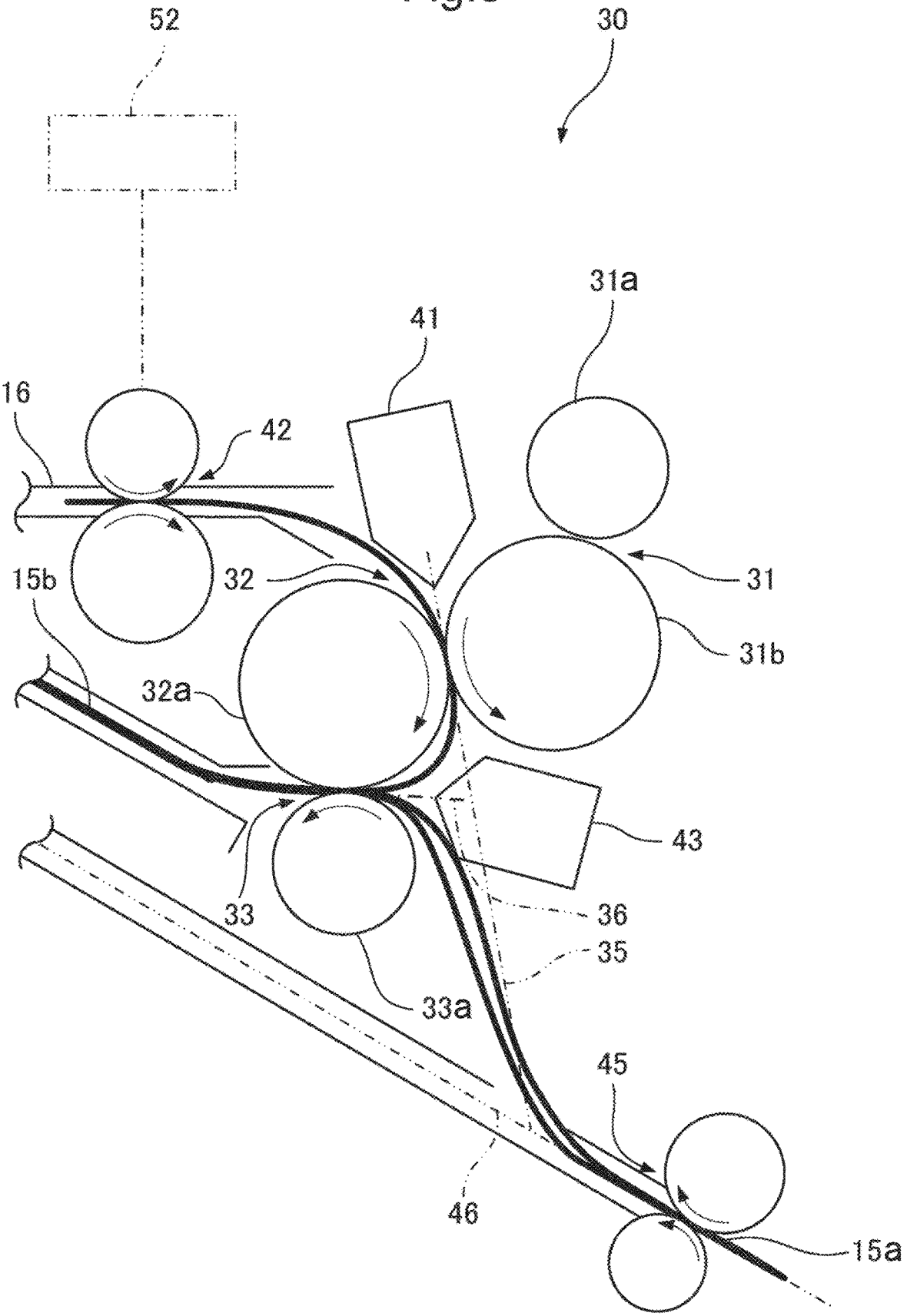
FIG. 5 is a schematic drawing showing the sheet being transported to a folded sheet transport lane.

Referring to FIG. 5, the portion of the sheet 15 where the second folding 15*b* has been formed is transported on the folded sheet transport lane 36. As the portion of the second folding 15*b* proceeds further along the folded sheet transport lane 36, the portion of the first folding 15*a*, and also the downstream end of the sheet 15 in the transport direction are also guided to the folded sheet transport lane 36. Therefore, finally the sheet 15, now having the first folding 15*a* and the second folding 15*b* formed thereon, is transported along the folded sheet transport lane 36.

The sheet 15 is transported along the folded sheet transport lane 36 to outside of the folding unit 30, and subjected to the postprocessing other than the folding, for example punching or stapling, by the postprocessing device 22. The sheet 15 that has passed the postprocessing device 22 is delivered to outside of the sheet postprocessing apparatus 20.

Here, when the sheet 15 is transported along the folded sheet transport lane 36, the transport direction of the sheet 15 by the retention roller pair 45 may be reversed, as shown in FIG. 5. In this case, for example, another bidirectional motor 52 than the one engaged with the reverse transport device 42, may be connected to the retention roller pair 45.

Figure 6:
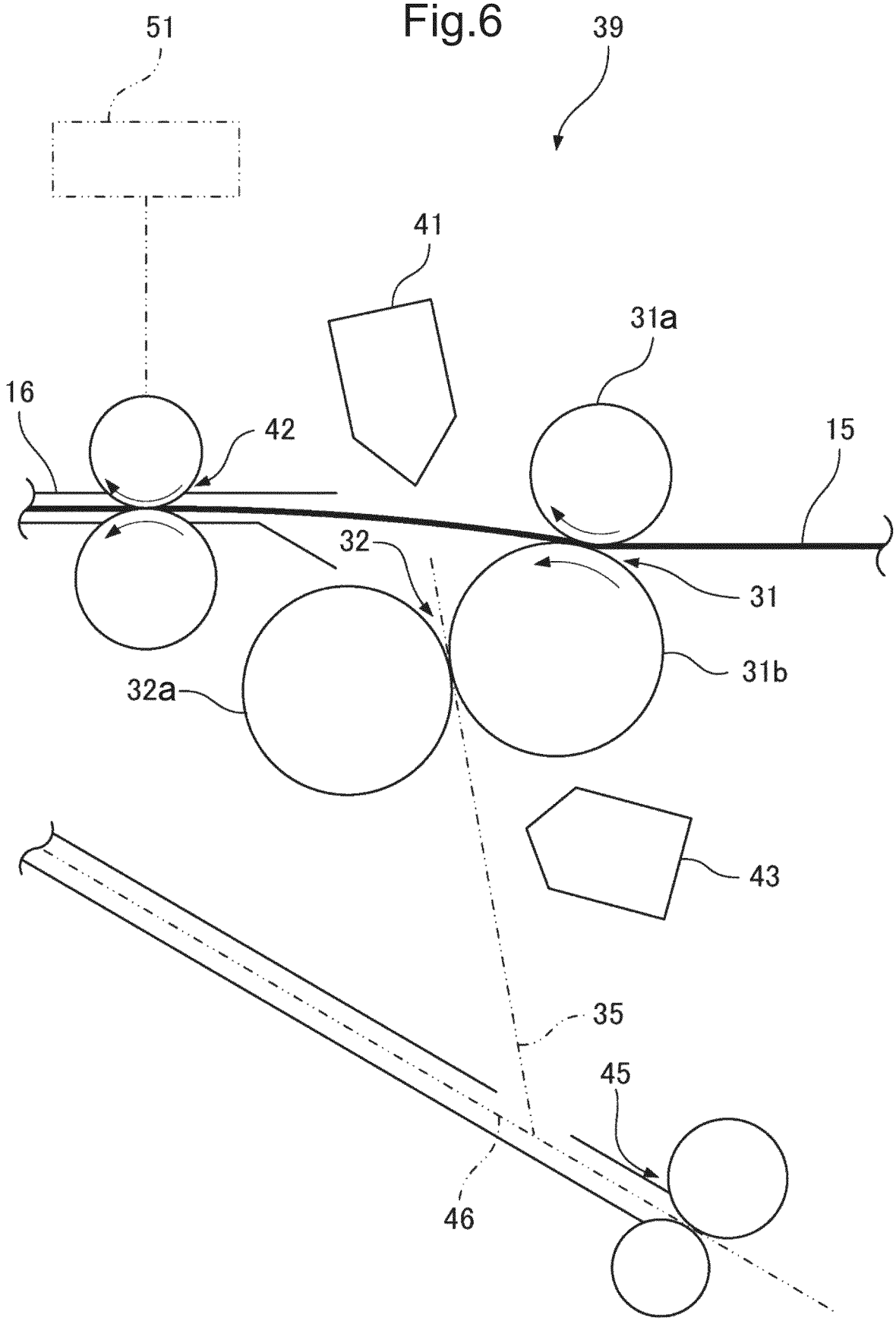
FIG. 6 is a schematic drawing showing the sheet being transported along the first transport lane, in a basic unit.

Referring now to FIG. 6, an operation performed when the basic unit 39 is mounted on the optional unit mounting base 24 shown in FIG. 1 will be described hereunder. FIG. 6 is a schematic drawing showing the sheet 15 being transported along the first transport lane 16, in the basic unit 39.

As shown in FIG. 6, the basic unit 39 includes the first roller pair 31 and the second roller pair 32. The first roller pair 31 and the second roller pair 32 are configured similarly to the first roller pair 31 and the second roller pair 32 provided in the folding unit 30. Preferably, the first roller pair 31 and the second roller pair 32 of the basic unit 39 may have the same structure as those of the folding unit 30.

As described above, the second transport lane 35, the first guide 41, the reverse transport device 42, the second guide 43, the retention roller pair 45, and the third transport lane 46 are provided inside the sheet postprocessing apparatus 20. When the basic unit 39 is mounted on the optional unit mounting base 24, the first roller pair 31 and the second roller pair 32 provided in the basic unit 39 are each structurally engaged with the sheet postprocessing apparatus 20, thereby constituting a part thereof. The mentioned components of the basic unit 39 serve to perform the transport and postprocessing of the sheet, in collaboration with the second transport lane 35, the first guide 41, the reverse transport device 42, the second guide 43, the retention roller pair 45, and the third transport lane 46, which are already provided in the sheet postprocessing apparatus 20, as shown in FIG. 6. In the sheet postprocessing apparatus 20, the optional unit mounting base 24 is configured to enable the basic unit 39 to be mounted and removed, in other words the first roller pair 31 and the second roller pair 32 to be mounted and removed.

When the first roller pair 31 and the second roller pair 32 in the basic unit 39 have the same structure as those of the folding unit 30, the basic unit 39 and the folding unit 30 have the common components, in the major part of the structure. Accordingly, since the units to be mounted on the optional unit mounting base 24 are commonly configured in the major part of the structure, irrespective of whether the folding function is provided, these units can be connected to other units by a common method, irrespective of whether the folding function is required. Such a configuration enables the user to mount the basic unit 39 or the folding unit 30 on the optional unit mounting base 24 with the same feeling, when either of the basic unit 39 and the folding unit 30 is to be mounted. Therefore, the folding function can be easily implemented and removed.

It is preferable that, when the basic unit 39 is mounted on the optional unit mounting base 24, the reverse transport device 42 is driven by the forward rotation motor 51. When the reverse transport device 42 is driven by the forward rotation motor 51, the reverse transport device 42 transports the sheet 15 only in one direction.

The motor for driving the reverse transport device 42 is switched between the forward rotation motor 51 and the bidirectional motor 52, depending on which of the basic unit 39 and the folding unit 30 is mounted on the optional unit mounting base 24. The forward rotation motor 51 or the bidirectional motor 52 is provided in the drive unit 26, separately located from the postprocessing device 22. When the bidirectional motor 52 is necessary, the user can simply mount the bidirectional motor 52 in the drive unit 26, without the need to make access to the reverse transport device 42. In other words, the user does not have to change the structure of the reverse transport device 42, whichever of the basic unit 39 and the folding unit 30 may be mounted on the optional unit mounting base 24. Therefore, the folding function can be easily implemented and removed.

Here, although the basic unit 39 and the folding unit 30 have the common structure in the major part, the basic unit 39 and the folding unit 30 are different from each other in some aspects. For example, the basic unit 39 shown in FIG. 6 is without the folded sheet transport lane 36 and the fourth roller 33*a*.

In other words, in the basic unit 39 the folded sheet transport lane 36 is excluded, and the third roller pair 33 is simplified. The exclusion of the folded sheet transport lane 36 and the simplification of the third roller pair 33 contribute to reducing the manufacturing cost of the basic unit 39, compared with the folding unit 30.

It is preferable that, when a part of the structure in the folding unit 30 is excluded from the basic unit 39, the connection arrangement between the excluded element and other units is maintained unchanged. For example, although the fourth roller 33*a* is not provided in the basic unit 39 shown in FIG. 6, the driving force of the drive source for the fourth roller 33*a*, in other words the driving force of the motor 28 in the drive unit 26 shown in FIG. 1, may be inputted to the basic unit 39.

Further, it is preferable that, in the basic unit 39, the input position of the driving force of the motor 28 in the drive unit 26, and the output position of the driving force from the basic unit 39 to other units, are located at the same positions as those of the folding unit 30.

When the input position and the output position of the driving force in the basic unit 39 are located at the same positions as those of the folding unit 30, the driving force for other units remains unchanged, irrespective of which of the folding unit 30 and the basic unit 39 is mounted on the optional unit mounting base 24.

It will be assumed, for example, that the driving force for the fourth roller 33*a* in the folding unit 30 is also transmitted to the component for performing the punching operation in the postprocessing device 22. In this case, when the input position and the output position of the driving force in the basic unit 39 are located at the same positions as those of the folding unit 30, the punching operation can be performed without any inconvenience, even when the basic unit 39 is mounted on the optional unit mounting base 24.

In the aforementioned known sheet postprocessing apparatus, the switchback of the sheet is performed, when a crease is to be formed on the sheet. To perform the switchback of the sheet, the motor for driving the roller that transports the sheet has to be the bidirectional motor, capable of rotating forward and reversely. However, the bidirectional motor is not provided in the sheet postprocessing apparatus without the folding function. Accordingly, it is difficult to add the folding function, to the sheet postprocessing apparatus without the folding function. Therefore, when the folding function is required, the entirety of the sheet postprocessing apparatus without the folding function has to be replaced with the sheet postprocessing apparatus having the folding function, which imposes a considerable burden in terms of the cost, when the folding function is implemented or removed.

In contrast, with the sheet postprocessing apparatus 20 according to the foregoing embodiment, the folding function can be easily implemented and removed. In addition, the configuration of the sheet postprocessing apparatus according to the embodiment contributes to reducing the cost for implementing or removing the folding function.

The embodiment of the disclosure has been described as above, with reference to the drawings. However, the disclosure is not limited to the foregoing embodiment, but may be modified in various manners, without departing from the scope of the disclosure. The drawings each schematically illustrate the elements for the sake of clarity, and the thickness, length, number of pieces, and interval of the illustrated elements may be different from the actual ones, because of the convenience in making up the drawings. Further, the material, shape, and size of the elements referred to in the foregoing embodiment are merely exemplary and not specifically limited, and may be modified as desired, without substantially departing from the configuration according to the disclosure.

INDUSTRIAL APPLICABILITY

The disclosure provides the sheet postprocessing apparatus, and is therefore industrially applicable.

What is claimed is:

1. A sheet postprocessing apparatus comprising:

a sheet inlet through which a sheet on which an image has been formed by an image forming apparatus is introduced;

a first transport lane on which the sheet introduced through the sheet inlet is transported;

a postprocessing device that performs postprocessing on the sheet;

a drive unit including a forward rotation motor capable of rotating forward, and configured to supply driving force for transporting the sheet, wherein the postprocessing device includes an optional unit mounting base, the optional unit mounting base is configured to allow one of a folding unit having a function to fold the sheet, and a basic unit without the folding function, to be selectively mounted, the drive unit includes a structure for additionally mounting a bidirectional motor capable of rotating reversely, when the basic unit is mounted on the optional unit mounting base, the drive unit supplies the driving force from the forward rotation motor, and when the folding unit is mounted on the optional unit mounting base, the drive unit supplies the driving force from the forward rotation motor and the bidirectional motor additionally mounted on the drive unit.

2. The sheet postprocessing apparatus according to claim 1, wherein the folding unit includes:

a first roller pair that transports the sheet on the first transport lane;

a second roller pair that applies a first folding to the sheet;

a third roller pair that applies a second folding to the sheet; and a folded sheet transport lane on which the sheet subjected to the first folding and the second folding is transported, the first roller pair includes a first roller and a second roller, the second roller pair includes the second roller and a third roller, and the third roller pair includes the third roller and a fourth roller.

3. The sheet postprocessing apparatus according to claim 2, wherein the optional unit mounting base is configured to enable the first roller pair, the second roller pair, the third roller pair, and the folded sheet transport lane provided in the folding unit to be mounted and removed.

4. The sheet postprocessing apparatus according to claim 2, wherein at least one reverse transport device capable of reversing a transport direction of the sheet is provided, the reverse transport device is driven by the bidirectional motor provided in the drive unit, when the folding unit is mounted on the optional unit mounting base, the transport direction of the sheet is reversed by the reverse transport device, when the bidirectional motor rotates reversely, and the sheet is guided to the second roller pair and the third roller pair, and the reverse transport device transports the sheet only in one direction, by being driven by the forward rotation motor provided in the drive unit, when the basic unit is mounted on the optional unit mounting base.

5. The sheet postprocessing apparatus according to claim 2, wherein the basic unit includes the first roller pair and the second roller pair, having the same structure as the first roller pair and the second roller pair provided in the folding unit.

6. The sheet postprocessing apparatus according to claim 5, wherein the optional unit mounting base is configured to enable the first roller pair and the second roller pair, provided in the basic unit, to be mounted and removed.

7. The sheet postprocessing apparatus according to claim 1, wherein, in the basic unit, an input position through which the driving force of the motor in the drive unit is inputted, and an output position through which the driving force is transmitted from the basic unit to another unit, are located at same positions as those of the folding unit.

* * * * *